US006973280B2

(12) United States Patent
Nukada et al.

(10) Patent No.: US 6,973,280 B2
(45) Date of Patent: Dec. 6, 2005

(54) IMAGE FORMING APPARATUS AND LIQUID DEVELOPER DRYING DEVICE

(75) Inventors: Hideki Nukada, Kanagawa-ken (JP); Atsuko Iida, Kanagawa-ken (JP); Noriko Yamamoto, Kanagawa-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 53 days.

(21) Appl. No.: 10/792,835

(22) Filed: Mar. 5, 2004

(65) Prior Publication Data

US 2004/0234298 A1 Nov. 25, 2004

(30) Foreign Application Priority Data

Mar. 31, 2003 (JP) ..... 2003-095083

(51) Int. Cl.[7] ..... G03G 15/10
(52) U.S. Cl. ..... 399/251; 399/249
(58) Field of Search ..... 399/251, 249, 399/250, 252, 348

(56) References Cited

U.S. PATENT DOCUMENTS 3,857,189 A 12/1974 Katayama et al.
3,957,369 A 5/1976 Wirth
4,870,462 A * 9/1989 Day ..... 399/249
4,952,980 A * 8/1990 Sato et al. ..... 399/142
5,221,944 A * 6/1993 Yoda et al. ..... 399/233
5,978,631 A 11/1999 Lee
6,650,857 B2 11/2003 Nukada et al. ..... 399/249
2002/0037181 A1 3/2002 Takahara

FOREIGN PATENT DOCUMENTS

JP 2002-278302 9/2002

OTHER PUBLICATIONS

Patent Abstracts of Japan, JP 58-162964, Sep. 27, 1983.

* cited by examiner

*Primary Examiner*—Louis Arana
(74) *Attorney, Agent, or Firm*—Oblon, Spivak, McClelland, Maier & Neustadt, P.C.

(57) ABSTRACT

A liquid-developer drying device includes a covering wall which has a facing surface covering and facing to part of an image-carrying body with a drying air passage between them. The image-carrying body carries developed image in a first direction along the drying air passage. The developed image includes liquid developer having toner particles and carrier liquid. The covering wall has a plurality of slits formed therein. The slits are distributed in a region with substantially less than half length along the facing surface covering the image-carrying body so as to blow dry air to the drying air passage in a second direction parallel to the first direction. Each of the slits extends across the drying air passage. The liquid-developer drying device also includes an air source supplying drying air to the slits.

15 Claims, 7 Drawing Sheets

FIG. 7

| | BLOWING SPEED [M / SEC] | | | | DRYNESS (%) |
|---|---|---|---|---|---|
| | MEASURING POINT | | | | |
| | S1 | S2 | S3 | S4 | |
| NOZZLE BLOCK 52 (PRESENT INVENTION) | 110 | 90 | | | 90 |
| NOZZLE BLOCK 60 (REFERENCE CASE) | | | 40 | 110 | 80 - 84 |

PRIOR ART

IMAGE FORMING APPARATUS AND LIQUID DEVELOPER DRYING DEVICE

BACKGROUND OF THE INVENTION

The present invention relates to a device for drying excess liquid developer and an apparatus for forming an image utilizing the drying device.

The liquid-process type image-forming apparatus, which produces a developed image by using liquid developer, has some important advantages. Firstly, it is able to realize high quality images owing to fine toner particles of sub-microns in diameter. Secondly, it is economical and is able to realize a quality comparable to that of printing (including offset printing), because sufficient image density can be obtained with a small amount of toner. Thirdly, it is able to accomplish energy saving because the toner can be fixed to a paper at a relatively low temperature, etc.

As part of an image forming process with the above-mentioned liquid-process, pressure transfer method can be used to transfer the toner image formed on a photosensitive member to a medium (such as paper) to be transferred to. In this method, adherence of the toner particles is utilized and the photosensitive member is brought into contact under pressure with the medium to be transferred to. With regard to the pressure transfer method, it has been confirmed that transferring can be effectively carried out if the liquid carrier on the surface of the developed image is sufficiently removed. On the other hand, transferring efficiency deteriorates if the surface of the photosensitive member is dampened with the liquid carrier when transferring process is carried out. Therefore, to improve transferring efficiency, excess liquid carrier on the image should be removed sufficiently before transferring process is carried out.

Recently, cutting down the time for removing the excess liquid carrier is required to reduce the time for the image forming process. To remove the excess liquid carrier on the developed image rapidly, a nozzle block 7 has been proposed as shown in FIG. 10. The nozzle block 7 has plural steps of nozzles 7*b* blowing drying air into a covering wall 7*a* along the surface of the photosensitive member 6, and faces to the photosensitive member 6 between the developing device 8 and the pressure-transferring device 9. In the gap between the covering wall 7*a* and the photosensitive member 6, the nozzle block 7 forms a drying passage 7*c* for the drying air to flow through. High speed drying air is blown from the plural steps of the nozzles 7*b*. The excess liquid carrier on the developed image is, therefore, rapidly removed by blowing the high speed drying air into the drying passage 7*c*.

However, further cut-down of the time for removing the excess carrier is required for further speedup of the image forming apparatus and improvement of the image quality today. Therefore, in spite of using the above-mentioned nozzle block, transfer efficiency by the pressure transfer method could be deteriorated because the excess liquid carrier might not be sufficiently removed before the developed image had reached the pressure transferring device.

BRIEF SUMMARY OF THE INVENTION

An object of the present invention is to solve the problem mentioned above and is intended to provide a drying device for a liquid developer and an image forming apparatus to obtain high quality images at a high speed. According to the present invention, the excess liquid carrier remaining on the developed image may be removed rapidly and securely before it is transferred, and transferring efficiency by the pressure transfer method may be improved in spite of speedup of the image forming process. Thereby, high quality transferred images can be obtained by avoiding occurrence of transfer defects.

According to an aspect of the present invention, there has been provided a liquid-developer drying device. The device includes a covering wall which has a facing surface covering and facing to part of an image-carrying body with a drying air passage between them. The image-carrying body carries developed image in a first direction along the drying air passage. The developed image includes liquid developer having toner particles and carrier liquid. The covering wall has a plurality of slits formed therein. The slits are distributed in a region with substantially less than half length along the facing surface covering the image-carrying body so as to blow dry air to the drying air passage in a second direction parallel to the first direction. Each of the slits extends across the drying air passage. The liquid-developer drying device also includes an air source which supplies drying air to the slits.

According to another aspect of the present invention, there has been provided an image forming apparatus. The apparatus includes an image-carrying body which carries latent electrostatic image in a first direction. The apparatus also includes a developing device which supplies liquid developer having toner particles and carrier liquid to the latent electrostatic image to form a developed image on the image-carrying body. The apparatus also includes a transferring device which transfers the developed image on the image-carrying body to a medium disposed outside of the image-carrying body. The apparatus also includes a covering wall which has a facing surface covering and facing to part of the image-carrying body with a drying air passage between them. The covering wall is disposed between the developing device and the transferring device. The covering wall has a plurality of slits formed therein. The slits are distributed in a region with substantially less than half length along the facing surface covering the image-carrying body so as to blow dry air to the drying air passage in a second direction parallel to the first direction. Each of the slits extends across the drying air passage. The apparatus also includes an air source which supplies drying air to the slits.

According to the construction mentioned above, high-speed air is blown along the conveying passage of the developed image in order to dry and remove securely the excess liquid carrier before it is transferred. In spite of speedup of the image forming process, the transferring efficiency by the pressure transfer method is improved, and furthermore high quality images can be obtained at a high speed.

BRIEF DESCRIPTION OF THE DRAWINGS

The above and other features and advantages of the present invention will become apparent from the discussion hereinbelow of specific, illustrative embodiments thereof presented in conjunction with the accompanying drawings, in which:

FIG. 7 is a table showing the speed of the drying air and the drying efficiency by the nozzle block of the first embodiment according to the present invention and a nozzle block of the reference case;

DETAILED DESCRIPTION OF THE INVENTION

Figure 1:
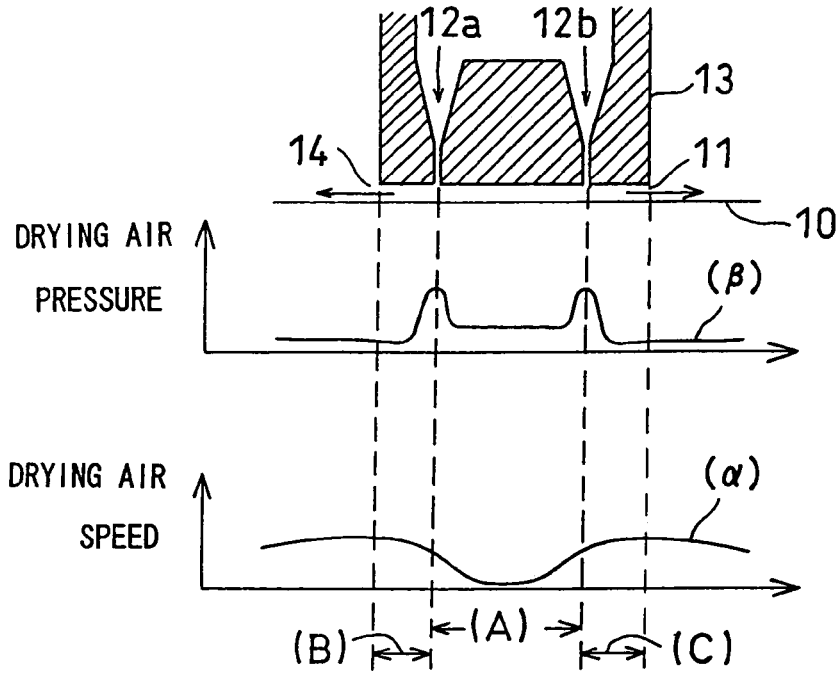
FIG. 1 is a schematic diagram explaining the principle of the present invention by using a two-step nozzle block.

First of all, the principle of the present invention will be described. Actual air speed and pressure were measure using a prior-art image forming apparatus. As shown in FIG. 1, a nozzle block 13 having first and second nozzles 12*a*, 12*b* located on a covering wall 11 along the surface of photosensitive member 10 was used. Measured speed of drying air generated in the drying passage 14 between the photosensitive member 10 and the nozzle block 13 is shown as a line (α).

Namely, the air speed in region (A) between the first nozzle 12*a* and the second nozzle 12*b* in the drying passage 14 decreased as compared with the air speeds in the other regions (B) and (C). The reason was that both the drying airs blown from the first nozzle 12*a* and the second nozzle 12*b* impinged each other and generated a high pressure at the position facing the first nozzle 12*a* and the second nozzle 12*b* in the drying passage 14 as represented by the line (β) of FIG. 1. Therefore, the air speed in the region (A) between the nozzle 12*a* and the nozzle 12*b* decreased relatively.

On the contrary, outlet ends of drying air were free in the regions (B) and (C), and the pressure was lower. Therefore, the air speed was very high, and thereby, drying efficiency became very high at the regions (B) and (C) where the drying air flew at a high speed.

Figure 2:
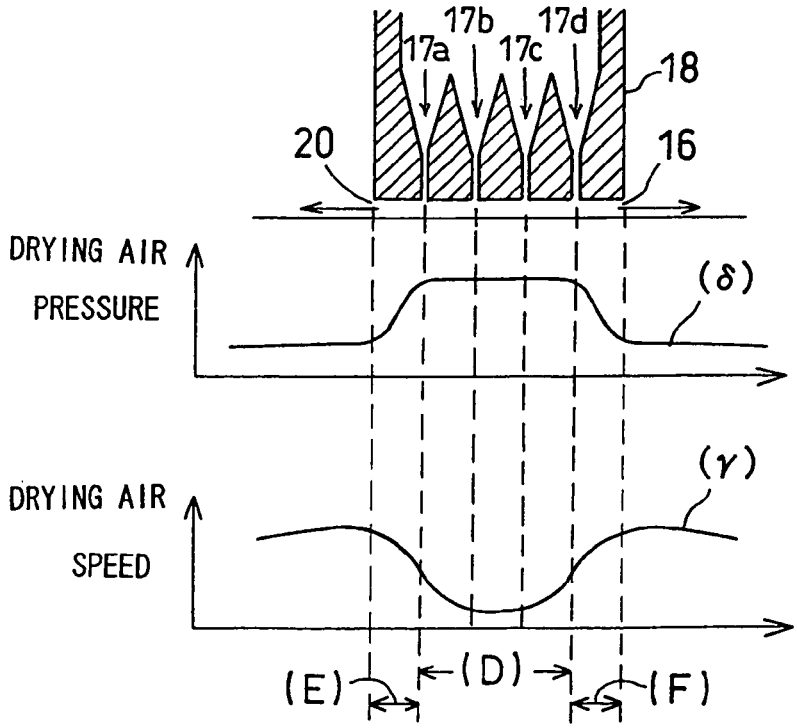
FIG. 2 is a schematic diagram explaining the principle of the present invention by using a four-step nozzle block.

As shown in FIG. 2, a nozzle block 18 having first to fourth nozzles 17*a*, 17*b*, 17*c* and 17*d* located on a covering wall 16 along the surface of photosensitive member 10 was used next. Measured speed of drying air generated in the drying passage 20 between the photosensitive member 10 and the nozzle block 18 is shown by a line (γ).

Namely, the air speed in the region (D) between the first and the fourth nozzles 17*a* and 17*d* decreased as compared with the air speeds in the both side regions thereof (E) and (F), when steps of nozzles located on the covering wall 16 were increased to heighten density of the air blowing into the drying passage 20. The reason was that air pressure increases much more at the position facing to the first to the fourth nozzles 17*a*, 17*b*, 17*c* and 17*d* in the drying passage 20 due to the drying air blown from the nozzles 17*a* to 17*d* as denoted by the line (δ) of FIG. 2. Therefore, the air speed in the region (D) between the nozzles 17*a* and 17*b* further decreased relatively.

On the contrary, increase of the air speed in response to the increase of nozzle steps was observed in the regions (E) and (F) where outlet ends of drying air were free. Therefore, drying efficiency became higher at the regions (E) and (F) where drying air flew at a very high speed.

As mentioned above, speed of the drying air, which passes between neighboring nozzles of the nozzle block having plural steps of nozzles, is generally suppressed relatively low by intervention of pressure, caused by the air blown from the neighboring nozzles. Thus, in the conventional nozzle block, which has plural steps of nozzles located uniformly on the whole region of the covering wall, speed of the drying air is suppressed low over quite a wide region in the drying passage. Consequently, drying efficiency is suppressed low in spite of the increased flow rate of the air from the nozzles.

Figure 3:
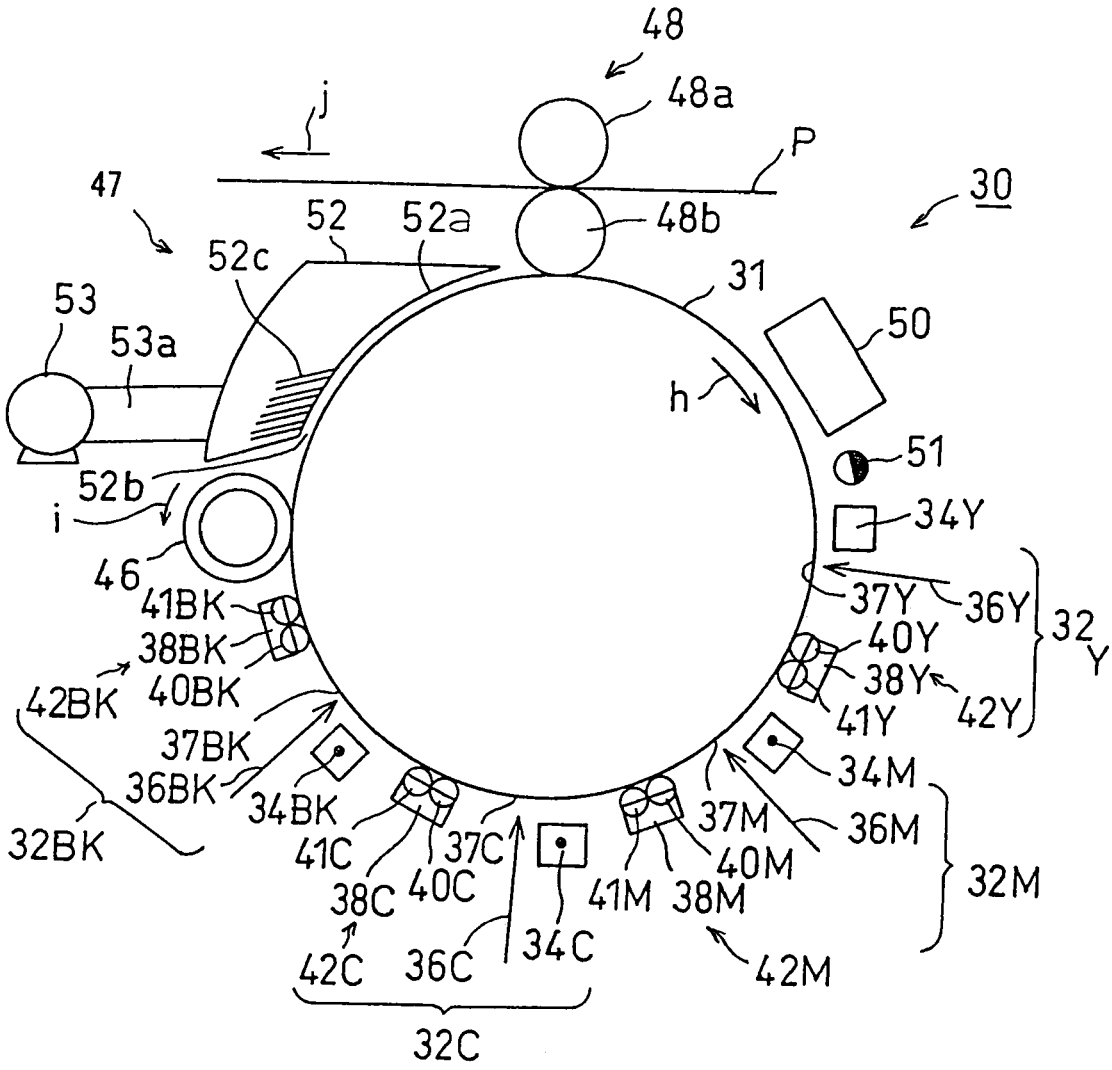
FIG. 3 is a schematic cross-sectional diagram showing an image-forming portion of a full-color electro-photographic apparatus of a first embodiment according to the present invention.
Figure 4:
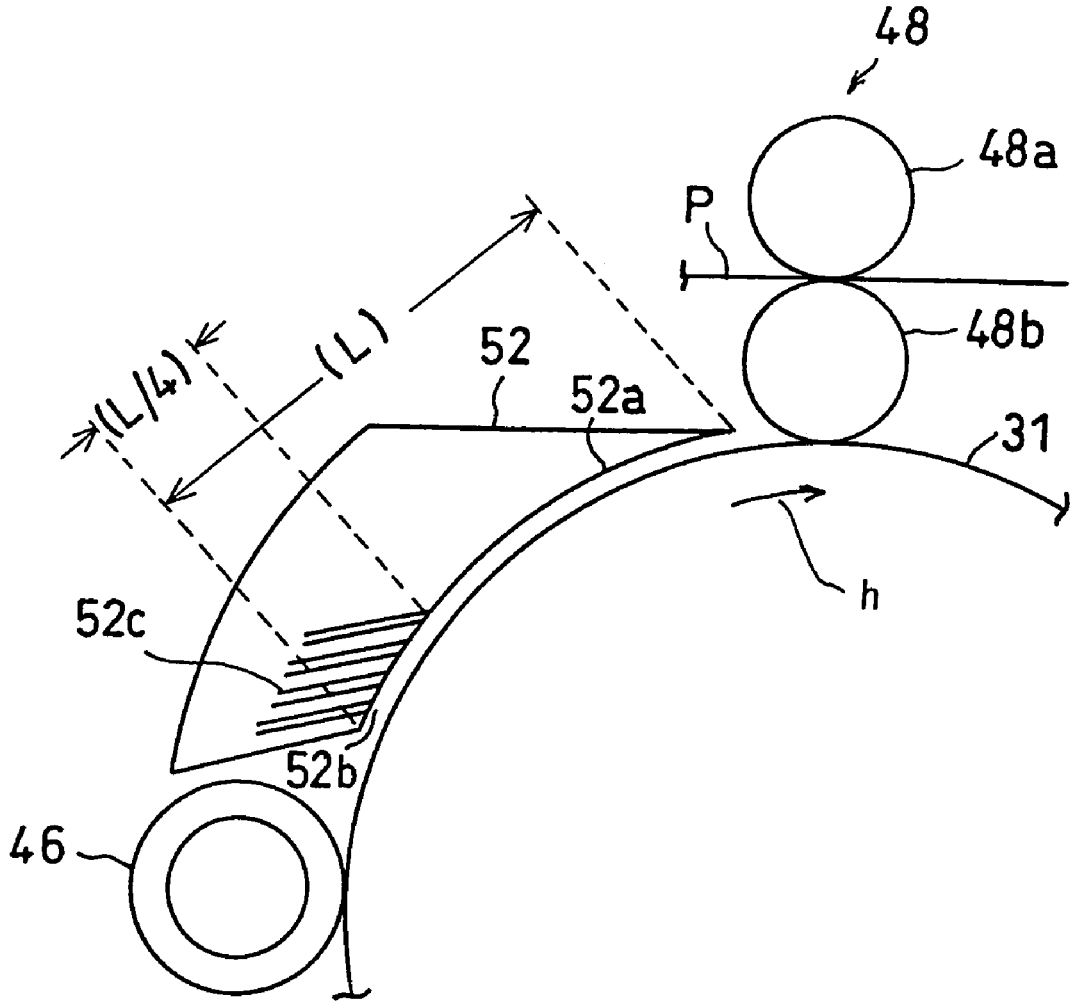
FIG. 4 is an enlarged schematic cross-sectional diagram showing the nozzles in the nozzle block and their vicinity shown in FIG. 3.
Figure 5:
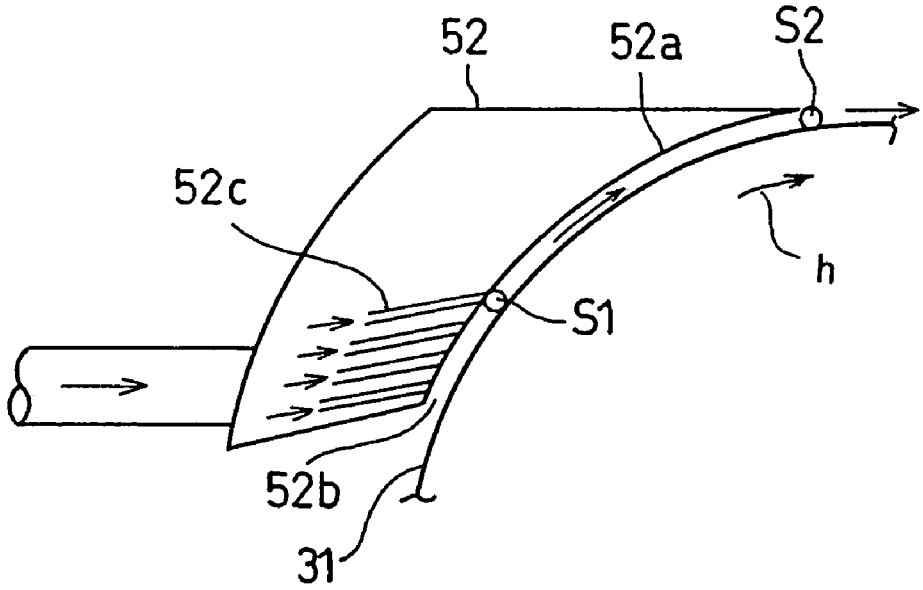
FIG. 5 is a schematic cross-sectional diagram showing the measuring points for the drying air in the drying passage shown in FIG. 4.

The present invention has been accomplished according to the principle mentioned above. Now a first embodiment according to the present invention is explained in detail referring to FIGS. 3 to 5. FIG. 3 shows an image forming portion 30 of a liquid-process type full-color electro-photographic apparatus i.e. the image forming apparatus of the present invention. The image forming portion 30 has a photosensitive drum 31 including a photosensitive layer of organic system or amorphous silicon system formed on an image-supporting member of an electric conductive substrate such as an aluminum substrate. On the periphery of the photosensitive drum 31, first to fourth image-forming units 32Y, 32M, 32C and 32BK are arranged along the rotation of the photosensitive drum 31 in the direction of an arrow h shown in FIG. 3. The image-forming units 32Y, 32M, 32C and 32BK form images on the photosensitive drum 31 sequentially with liquid developers of yellow (Y), magenta (M), cyan (C), and black (BK), respectively.

Although colors of the liquid developers to be used for the image-forming units 32Y to 32BK are different from each other, the units have basically the same construction except for the colors. Explanation will be, therefore, carried out referring to the image-forming unit 32Y of yellow (Y) positioned upstream. With regard to the other image-forming units 32M, 32C and 32BK, explanation will be omitted by giving the same mark and a suffix denoting each color to the same part as that of the unit 32Y.

The image-forming unit 32Y of yellow (Y) has a charger 34Y which may include a well-known corona charger or scorotron charger. The image forming unit 32Y also has an exposing portion 37Y, which selectively irradiates a laser beam Y corresponding to the light signal of yellow (Y) emitted from a laser irradiation device (not shown).

The image-forming units 32Y to 32BK also have developing rollers 40Y to 40BK accommodating liquid developers 38Y to 38BK for respective colors and feeding the liquid developers 38Y to 38BK to the photosensitive roller 31 to form a developed image. The image-forming units 32Y to 32BK also have developing devices 42Y to 42BK which include squeezing rollers 41Y to 41BK located apart from the photosensitive drum 31 with a slight clearance of 20 to 50 micrometers and removing simultaneously fogs and liquid carriers from the developed image after development.

The liquid developers 38Y to 38BK may have toner particles of 0.1 to 0.2 micrometer in diameter having different colors from each other, and liquid carriers to disperse the toner particles. As the liquid carriers, non-polar solvent of petroleum system such as ISOBAR L (Product of Exxon Inc.) may be utilized, for example.

A porous elastic roller 46 or a liquid-removing member to remove excess liquid carriers remaining in the photosensitive drum 31 after development is provided at the downstream side of the image-forming units 32Y to 32BK on the periphery of the photosensitive drum 31. Furthermore, a drying device 47 is provided in the region between the porous elastic roller 46 and a transferring device 48 transferring the developed image under pressure. The drying device 47 dries and removes the excess liquid carriers remaining on the photosensitive drum 31 by the aid of drying air.

The porous elastic roller 46 has a fine porous elastic surface having electric conductivity for preventing the toner particles from sticking, and accelerates sucking rate of the liquid carrier by the aid of the capillary phenomenon. Preferably, a rubber system material with elasticity such as polyurethane sponge may be used for the porous elastic material, for example. The liquid-removing member is not limited to the porous elastic roller but may be used with the photosensitive member being in contact with a roller formed of oleophilic material such as silicon rubber.

The transferring device 48 has a pressing roller 48*a* and an intermediate transfer roller 48*b* pressed against the photosensitive drum 31 by the pressing roller 48*a* with a pressure force of approximately 0.5to 50 kgf/cm$^2$ (or 0.049 to 4.9 MPa). The transferring device 48 transfers primarily the toner image of toner particles formed on the photosensitive drum 31 to the intermediate transfer roller 48*b* by utilizing adherence of the toner particles, and then transfers the image secondarily to a paper P or a member to be finally transferred to. Additionally, a cleaner 50 removing the toner particles remaining on the photosensitive drum 31 and an erasing lamp 51 erasing charges remaining on the photosensitive drum 31 are disposed at the downstream side of the transferring device 48 along the periphery of the photosensitive drum 31.

The drying device 47 for drying and removing excess liquid carrier remaining on the photosensitive drum 31 is now described in detail. The drying device 47 has a nozzle block 52 and a blower 53 that is an air source sending air to the nozzle block 52. The nozzle block 52 has a covering wall 52*a*, which covers the surface of the photosensitive drum 31 between the porous elastic roller 46 and the intermediate transfer roller 48*b*. A drying passage 52*b* of approximately 2 mm in width is formed between the covering wall 52*a* and the photosensitive drum 31.

Drying air flows in the direction of arrow h, which is the same direction as the rotation direction of the photosensitive drum 31, and flows near the surface of the photosensitive drum 31 in the drying passage 52*b*. The surface of the covering wall 52*a* is formed in a smooth shape without roughness so that the drying air may pass the drying passage 52*a* without generating turbulence. The covering wall 52*a* may be made of aluminum or stainless steel buffed with a file of fineness JIS (Japanese Industrial Standard) No. 600 or so, and formed in a cylindrical concave surface to fit substantially coaxially with the surface of the photosensitive drum 31.

On the covering wall 52*a*, nozzles 52*c* or openings to blow the drying air onto the surface of the photosensitive drum 31 are formed in four steps. The nozzles 52*c* have the shape of slits extending in the axial direction of the photosensitive drum 31 or perpendicular to the circumferential direction of the photosensitive drum 31. The nozzles 52*c* are supplied with airflow from the blower 53 through a pipe 53*a*. The four step nozzles 52*c* are distributed only in the upstream side (or the side closer to the porous elastic roller 46) in the drying passage 52*b*, preferably within approximately a quarter of the total length L of the covering wall 52*a*.

Operation of the first embodiment is now described. The photosensitive drum 31 rotates in the direction of arrow h after image-forming process starts. The photosensitive drum 31 is charged by the charger 34Y at the image-forming unit 32Y, and then is selectively irradiated by a laser beam 36Y emitted from a laser device (not shown) corresponding to the image information of yellow. Thus, an electrostatic latent image corresponding to yellow (Y) image is formed.

Toner particles of the liquid developer 38Y of yellow (Y) are fed into the clearance between the photosensitive drum 31 and the developing roller 40Y located in non-contact manner with the photosensitive drum 31. Then the toner particles are adsorbed by electrophoresis, and the toner image of yellow (Y) is formed on the photosensitive drum 31.

Thereafter, the squeeze roller 41Y removes extended toner particles. The squeeze roller 41Y may scrape liquid carrier in the liquid developer, which remains on the photosensitive drum 31 when the developing process is carried out, to reduce the quantity of excess carrier liquid in advance.

Similarly, toner images of magenta (M), cyan (C), and black (BK) are sequentially superimposed by succeeding image-forming units 32M to 32BK, and a full-color developed image is formed on the photosensitive drum 31.

After development has finished, excess liquid carrier of the full-color developed image on the photosensitive drum 31 is absorbed by the surface of the porous elastic roller 46 by the aid of capillary phenomenon of the porous elastic roller 46. The porous elastic roller 46 rotates such that the peripheral velocity of the porous elastic roller 46 in the direction of arrow i is the same as that of the photosensitive drum 31. Thus, disturbance of the developed image on the photosensitive drum 31 is suppressed.

A bias voltage with the polarity reverses to that of the toner particles is then applied to the porous elastic roller 46. Thereby, the toner particles are prevented from being exfoliated from the surface of the photosensitive drum 31, and deterioration of the image is suppressed. In addition, the surface of the porous elastic roller 46 is prevented from being clogged by absorption of the toner particles when excess liquid carrier is absorbed and removed.

After excess liquid carrier is absorbed and removed by the porous elastic roller 46, the developed image on the photosensitive drum 31 passes the drying passage 52*b* for the drying air, which is formed by the covering wall 52*a* of the nozzle block 52. The nozzle block 52 blows airflow fed by the blower 53 onto the surface of the photosensitive drum 31 through the four step nozzles 52*c* as the drying air.

Thereafter, the drying air passes the region where the nozzles 52*c* are not formed in the drying passage 52*b*, where the drying air is not adversely affected by the air pressure from the nozzles 52*c*. Thus, the drying airflow remains at high speed. Moreover, the drying airflow is not affected by the turbulence caused by unevenness of the surface of the covering wall 52*a*, so that it is kept at high speed.

Consequently, because the developed image on the photosensitive drum 31 is continuously blown by the high speed drying air while it is conveyed in the drying passage 52*b* after the region where the nozzles 53*c* are formed, remaining excess liquid carrier can be sufficiently dried and removed rapidly.

When the developed image from which excess liquid carrier has been removed as mentioned above reaches the transferring device 48, the developed image on the photosensitive drum 31 is transferred primarily to the intermediate transfer roller 48*b*. The intermediate transfer roller 48*b* is pressed against the photosensitive drum 31 by the load of the pressing roller 48*a*. Then, the transferred image is further transferred secondarily to the paper P conveyed from the intermediate transfer roller 48*b* in the direction of arrow j. Thus, a full-color image is formed on the paper P. Excess liquid carrier is sufficiently dried and removed from the developed image on the photosensitive drum 31 before the pressure transferring is carried out by the transferring device 48, as described above. Therefore, adhesive force of the toner particles does not deteriorate and the developed image is transferred to the intermediate transfer roller 48*b* and then to the paper P with a high transferring efficiency. After the transferring is finished, the cleaner 50 removes the remaining toner particles on the photosensitive drum 31, and the erasing lamp 51 erases the remaining charge. Thus, a series of image-forming process finishes and the photosensitive drum 31 gets ready for the next image-forming process.

The nozzle block 52 of this embodiment was installed in an experimental electro-photographic apparatus for performance tests. Then, speed of the drying airflow at the first measuring point (S1) and at the second measuring point (S2) in the drying passage 52*c* formed by the photosensitive drum 31 and the nozzle block 52 was measured. Drying efficiency of the developed image was also measured after it has passed the drying passage 52*c*. FIG. 7 shows the results obtained from the measurement.

Figure 6:
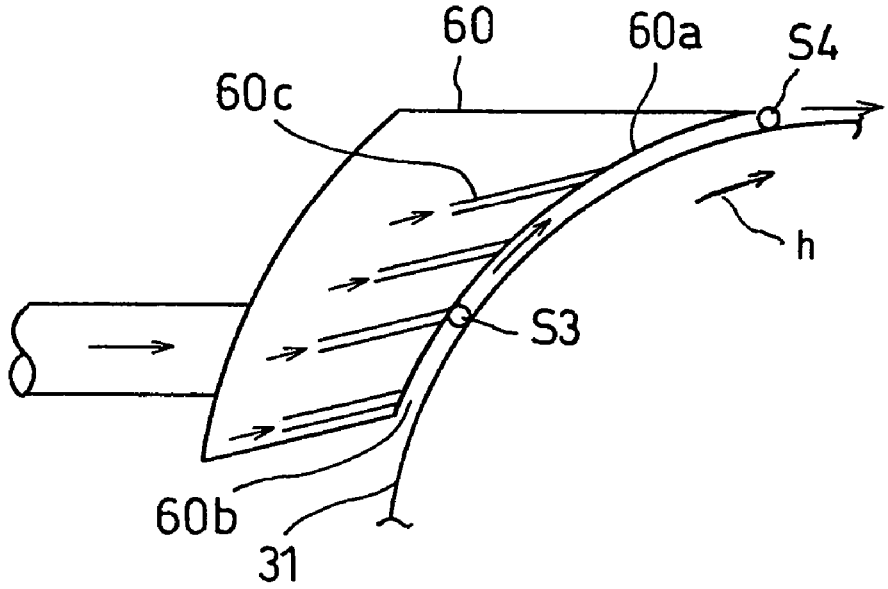
FIG. 6 is a schematic cross-sectional diagram showing the measuring points for the drying air of a reference case.

In comparison to the above, a conventional nozzle block 60 having four step nozzles 60*c* arranged with an equal interval was installed in the experimental electro-photographic apparatus mentioned above, as shown in FIG. 6. Then, speed of the drying air at the third measuring point (S3) and at the fourth measuring point (S4) in the drying passage 60*b* formed by the photosensitive drum 31 and the nozzle block 60 was measured. Drying efficiency of the developed image after it has passed the drying passage 60*b* was also measured. FIG. 7 also shows the results obtained from the measurement of this reference case. Blowing speeds of the drying air from the nozzles 52*c* and the nozzles 60*c* were set to be the same in the tests.

In the case of the nozzle block 52 of this embodiment, the nozzles 52*c* are formed only in the region of a length of about L/4 on the upstream side of the whole length (L) of the nozzle block 52. The drying air speeds up at the first measuring point (S1) shortly after it has passed the region where the nozzles 52*c* are formed. Thereafter, the drying air can maintain its high speed without being affected by air pressure caused by blowing from the nozzles in the remaining region of the length of 3 L/4 on the downstream side of the nozzle block 52. On the other hand, in the case of the prior-art nozzle block 60 (reference case), the drying air cannot get a high speed at the third measuring point (S3), because it is adversely affected by air pressure caused by blowing from the downstream nozzle 60*c*. The drying air can finally get a high speed at the fourth measuring point (S4) in the vicinity of the outlet of the drying passage 60*b* at the downstream end of the nozzle block 60.

Thus, the drying passage 52*b* in the nozzle block 52 of this embodiment provides higher speed of drying air in a larger area than the drying passage 60*b* in the nozzle block 60 of the reference case to the developed image. Therefore, the drying efficiency of the developed image for the nozzle block 52 of this embodiment can be improved compared to the reference case. Then, the image can be dried in a short time, and speedup of the apparatus and downsizing of the blower can be achieved.

In the structure mentioned above, sufficient quantity of air to speed up the drying air can be obtained by locating the four step nozzles 52*c* at the upstream side of the whole length of the nozzle block 52. The drying air merely passes through in the downstream side of the nozzle block 52. The upstream region into which the drying air is blown and the downstream region where the drying air passes are divided from each other, so that the drying air in the drying passage 52*b* can keep its high speed for a long time. Consequently, because the drying efficiency is improved, the developed image can be sufficiently dried in spite of speedup of image-forming process. When pressure transferring is carried out, transferring defect due to insufficient removing of excess liquid carrier can be prevented or suppressed, so that a high quality transferred image can be obtained with a high transferring efficiency. Then, a high-speed image-forming apparatus can be realized.

Figure 8:
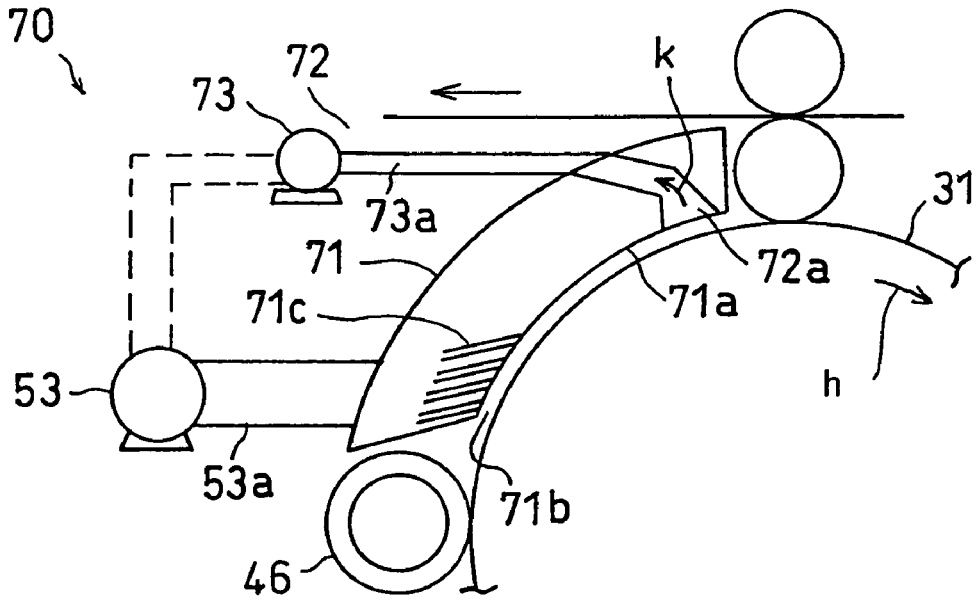
FIG. 8 is a schematic cross-sectional diagram showing the drying device of a second embodiment according to the present invention.

Now a second embodiment according to the present invention is explained referring to FIG. 8. The second embodiment has a collecting mechanism for the drying air at the downstream side of the nozzle block, added to the structure of the above-mentioned first embodiment. Because the other portions are the same as the first embodiment, the portions of the same structure as the structure explained in the first embodiment will be denoted by the same marks and detailed explanation thereof will be omitted.

The drying device 70 of this embodiment is provided with a collecting mechanism 72 for collecting the drying air blown out to the drying passage 71*b* by a nozzle block 71. Four step nozzles 71*c* are formed only on the region of the upstream side of about ¼ of the covering wall 71*a* of the nozzle block 71 facing the photosensitive drum 31 interposed by the drying passage 71*b*.

A suction port 72*a* or a collecting member is formed at the downstream side of the covering wall 71*a* to collect the drying air. The suction port 72*a* is communicated to a compressor 73 through a pipe 73*a* and sucks the drying air containing vaporized liquid carrier in the direction of arrow k shown in FIG. 8, while it passes the drying passage 71*b*. The drying air sucked from the suction port 72*a* is sent to a filter (not shown) to collect liquid carrier. Then, the drying air is fed again to the nozzles 71*c* via a blower 53 via. Thus, the drying air circulates inside the drying device 70 without being exhausted.

In accordance with the construction of the second embodiment described above, the developed image can be sufficiently dried in spite of speedup of image-forming process, as the first embodiment. Then, a high quality transferred image can be obtained with a high transferring efficiency, and a high-speed image-forming apparatus can be realized. Furthermore, evaporated liquid carrier can be prevented from diffusing to the environment, by circulating the drying air inside the drying device 70, which result in environment conservation.

The present invention is not limited to the embodiments described above, but any modification thereof can be available within the scope of the invention where the purpose of the invention does not change. For example, the image-supporting member may be a photosensitive belt where the photosensitive layer is formed on the surface of a rotatable annular elastic belt. The transferring device may transfer an image directly from the photosensitive drum to the paper without the intermediate transfer roller intervening between them. The pressure force is also not limited.

Step number of the nozzles or openings to blow the drying air onto the image-supporting member is not restricted. Locations of the nozzles are not restricted, so long as they are distributed mainly on the upstream side of the covering wall. The openings are preferably located within the region of a half length of the covering wall on the upstream side in order to secure a long high-speed region of the drying air.

Although the width of the drying passage is arbitrary so long as speedup of the drying air can be maintained, the width of the drying passage is preferably narrowed down to about 0.5 to 5 mm, to increase the speed of the drying air. The width of the slit-like openings is also preferably narrowed in order to blow the drying air with a higher speed. The cross section of the drying passage must be narrowed as compared to the area of the openings to raise the speed of the drying air in the drying passage. Therefore, the cross section of the drying passage is preferably set smaller in comparison with the total area of plural steps of the openings.

Figure 9:
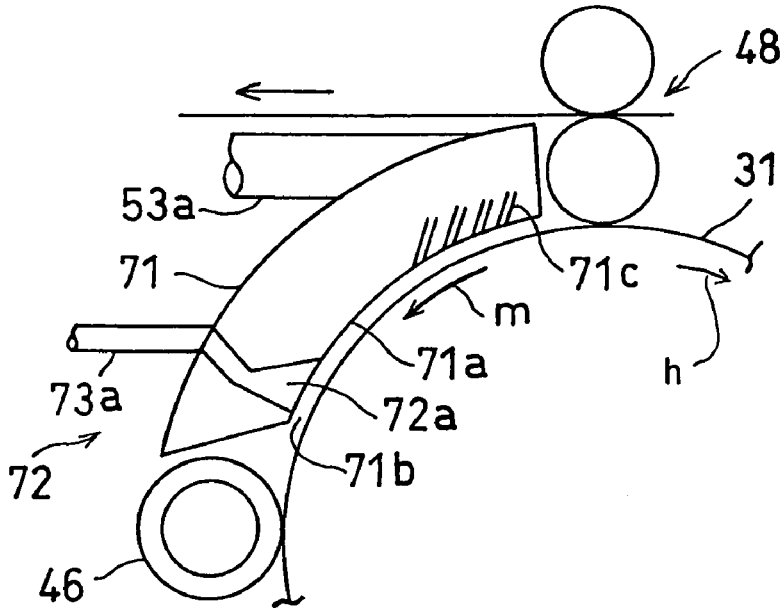
FIG. 9 is a schematic cross-sectional diagram showing the nozzle block of a modification of the second embodiment according to the present invention.
Figure 10:
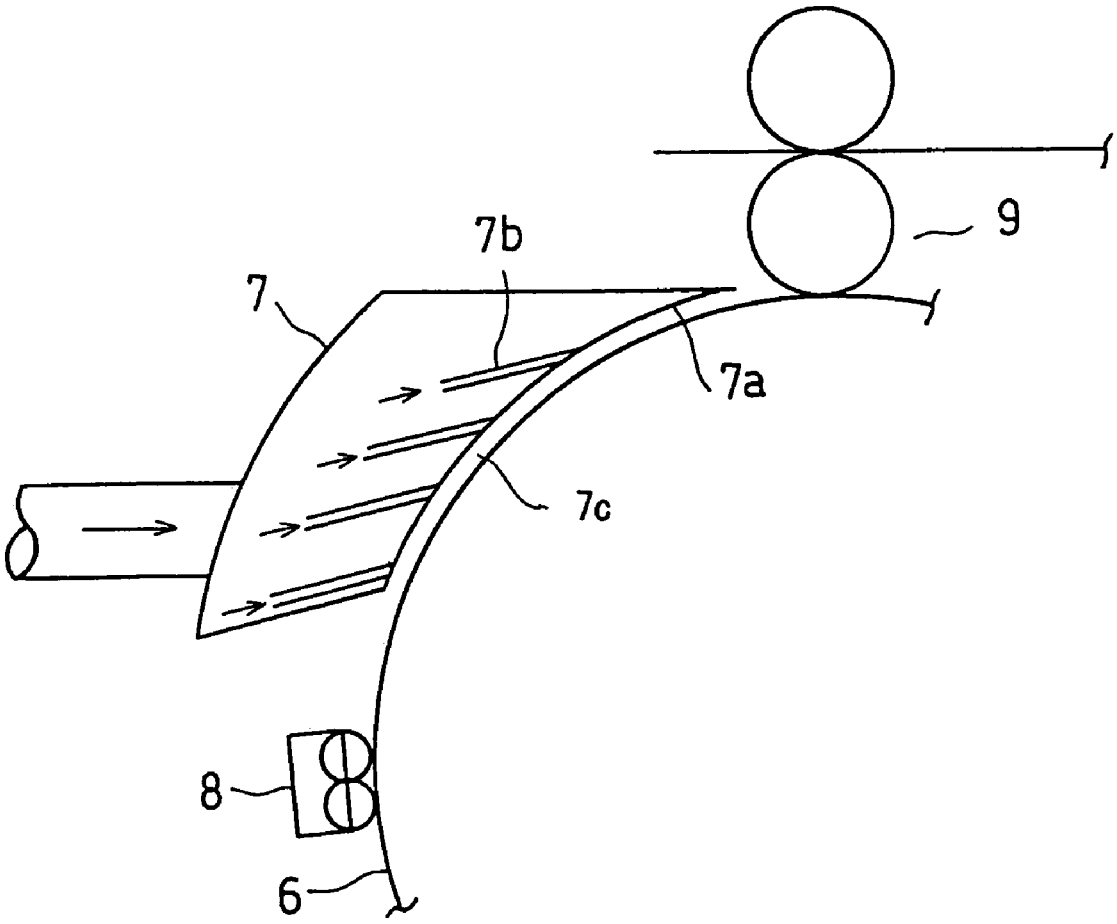
FIG. 10 is a schematic cross-sectional diagram showing a conventional nozzle block.

Blowing direction of the drying air by the drying device is not restricted. For instance, as a modification of the second embodiment, the upstream side and the downstream side of the nozzle block 71 may be reversed as shown in FIG. 9. Namely, the region where the nozzles 71 *c* are located may be positioned at the side of the transferring device 48, and the suction port 72*a* sucking the drying air may be positioned at the side of the porous elastic roller 46. Thus, the drying air blown from the nozzles 71*c* flows in the direction of arrow m which is in the reverse direction of the rotation direction h of the photosensitive drum 31. Then, the drying air is sucked into the suction port 72*a* side. This structure may be preferable especially when the transferring device 48 is heated up to enhance transferring efficiency, because the drying air is prevented from blowing to the transferring device 48 and cooling of the transferring device 48 is avoided.

Furthermore, the liquid carrier collected by the filter etc. may be recycled and reused in the second embodiment.

What is claimed is:

1. An image forming apparatus comprising:

an image-carrying body carrying latent electrostatic image in a first direction;

a developing device supplying liquid developer having toner particles and carrier liquid to the latent electrostatic image to form a developed image on the image-carrying body;

a transferring device transferring the developed image on the image-carrying body to a medium disposed outside of the image-carrying body;

a covering wall having a facing surface covering and facing to part of the image-carrying body with a drying air passage between the facing surface and the image-carrying body, the covering wall being disposed between the developing device and the transferring device, the covering wall having a plurality of slits formed into the covering wall, the slits being distributed in a region with substantially less than half length along the facing surface covering the image-carrying body; and an air source supplying drying air to the passage in a second direction parallel to the first direction through a slit.

2. The image forming apparatus according to claim 1, wherein the facing surface is shaped to fit the image-carrying body.

3. The image forming apparatus according to claim 1, wherein the second direction is the same as the first direction.

4. The image forming apparatus according to claim 1, wherein the second direction is opposite to the first direction.

5. The image forming apparatus according to claim 1, wherein the drying air passage has a first cross-sectional area across the first direction, the first cross-sectional area being smaller than a total flow area of the plurality of the slits.

6. The image forming apparatus according to claim 1, further comprising an air collector collecting drying air near an end of the drying air passage further to the region where the slits are distributed.

7. The image forming apparatus according to claim 6, further comprising a filter removing the liquid developer in the drying air collected by the air collector, wherein the drying air from the filter being circulated to the air source.

8. The image forming apparatus according to claim 1, further comprising a liquid removing device removing the carrier liquid from the developed image, the liquid removing device disposed in contact with the developed image between the developing device and the covering wall.

9. A liquid-developer drying device comprising:

a covering wall having a facing surface covering and facing to part of an image-carrying body with a drying air passage between the facing surface and the image-carrying body, the image-carrying body carrying developed image in a first direction along the drying, air passage, the developed image including liquid developer having toner particles and carrier liquid, the covering wall having a plurality of slits formed therein, the slits being distributed in a region with substantially less than half length along the facing surface covering the image-carrying body so as to blow dry air to the drying air passage in a second direction parallel to the first direction, each of the slits extending across the drying air passage; and an air source supplying drying air to the slits.

10. The liquid-developer drying device according to claim 9, wherein the facing surface is shaped to fit the image-carrying body.

11. The liquid-developer drying device according to claim 9, wherein the second direction is the same as the first direction.

12. The liquid-developer drying device according to claim 9, wherein the second direction is opposite to the first direction.

13. The liquid-developer drying device according to claim 9, wherein the drying air passage has a first cross-sectional area across the first direction, the first cross-sectional area being smaller than a total flow area of the plurality of the slits.

14. The liquid-developer drying device according to claim 9, further comprising an air collector collecting drying air near an end of the drying air passage further to the region where the slits are distributed.

15. The liquid-developer drying device according to claim 14, further comprising a filter removing the liquid developer in the drying air collected by the air collector, wherein the drying air from the filter being circulated to the air source.

* * * * *